US009024171B2

(12) United States Patent
Lace

(10) Patent No.: US 9,024,171 B2
(45) Date of Patent: May 5, 2015

(54) SENSOR ASSEMBLY FOR STRINGED MUSICAL INSTRUMENTS

(75) Inventor: Jeffrey J. Lace, Huntington Beach, CA (US)

(73) Assignee: Actodyne General, Inc., Cypress, CA (US)

( * ) Notice: Subject to any disclaimer, the term of this patent is extended or adjusted under 35 U.S.C. 154(b) by 270 days.

(21) Appl. No.: 12/863,298

(22) PCT Filed: Jan. 16, 2008

(86) PCT No.: PCT/US2008/000517

§ 371 (c)(1),
(2), (4) Date: Jul. 16, 2010

(87) PCT Pub. No.: WO2009/091360

PCT Pub. Date: Jul. 23, 2009

(65) Prior Publication Data

US 2011/0048215 A1 Mar. 3, 2011

(51) Int. Cl.

| | |
|---|---|
| ***G10H 3/00*** | (2006.01) |
| ***G10H 3/14*** | (2006.01) |
| ***G10H 3/18*** | (2006.01) |

(52) U.S. Cl.

CPC ..... *G10H 3/181* (2013.01); *G10H 2220/505* (2013.01)

(58) Field of Classification Search

None

See application file for complete search history.

(56) References Cited

U.S. PATENT DOCUMENTS

| | | | | |
|---|---|---|---|---|
| 4,809,578 | A | 3/1989 | Lace, Jr. | |
| 5,054,356 | A | 10/1991 | Farnell, Jr. | |
| 5,336,845 | A | 8/1994 | Lace, Sr. | |
| D354,507 | S | 1/1995 | Lace | |
| 5,401,900 | A | 3/1995 | Lace | |
| 5,418,327 | A | 5/1995 | Lace, Sr. et al. | |
| 5,430,246 | A | 7/1995 | Lace, Sr. et al. | |
| 5,438,157 | A | 8/1995 | Lace, Sr. et al. | |
| 5,464,948 | A | 11/1995 | Lace | |
| 5,569,872 | A * | 10/1996 | Gimpel | 84/728 |
| 5,641,932 | A | 6/1997 | Lace | |
| 5,684,263 | A | 11/1997 | Lace | |
| 5,767,431 | A * | 6/1998 | Khanagov | 84/726 |
| 5,831,196 | A * | 11/1998 | Khanagov | 84/726 |
| 5,894,101 | A * | 4/1999 | Damm | 84/728 |
| 6,111,185 | A | 8/2000 | Lace | |
| 6,372,976 | B2 * | 4/2002 | Damm | 84/723 |
| 6,897,369 | B1 * | 5/2005 | Lace | 84/727 |
| 7,015,390 | B1 | 3/2006 | Rogers | |
| 7,135,638 | B2 * | 11/2006 | Garrett et al. | 84/725 |

(Continued)

OTHER PUBLICATIONS

Oct. 4, 2012 International Preliminary Report on Patentability for PCT/US08/00517.

*Primary Examiner* — Marlon Fletcher

(74) *Attorney, Agent, or Firm* — Howard & Howard Attorneys PLLC

(57) ABSTRACT

A sensor assembly for a stringed musical instrument having a plurality of movable strings includes a primary winding extending outward to form a mounting member and adapted to be disposed on the stringed musical instrument. The sensor assembly includes at least one magnet disposed adjacent the primary winding to generate a magnetic field. The primary winding creates a primary current from a disruption in the magnetic field by the movable strings and the primary current creates a primary electromagnetic flux. The sensor assembly further includes at least one secondary being coupled to the primary winding. The at least one secondary winding transforms the primary electromagnetic flux into a secondary current adapted to pass out the stringed musical instrument.

15 Claims, 8 Drawing Sheets

(56) References Cited

U.S. PATENT DOCUMENTS

| | | | | |
|---|---|---|---|---|
| 7,227,076 | B2 * | 6/2007 | Stich | 84/726 |
| 7,718,886 | B1 * | 5/2010 | Lace | 84/727 |
| 8,853,517 | B1 * | 10/2014 | Dixon | 84/726 |
| 2004/0003709 | A1 | 1/2004 | Kinman | |
| 2005/0109197 | A1 * | 5/2005 | Garrett et al. | 84/726 |
| 2007/0056435 | A1 * | 3/2007 | Juszkiewicz et al. | 84/726 |
| 2011/0048215 | A1 * | 3/2011 | Lace | 84/726 |
| 2012/0103170 | A1 * | 5/2012 | Kinman | 84/726 |

* cited by examiner

FIG 1
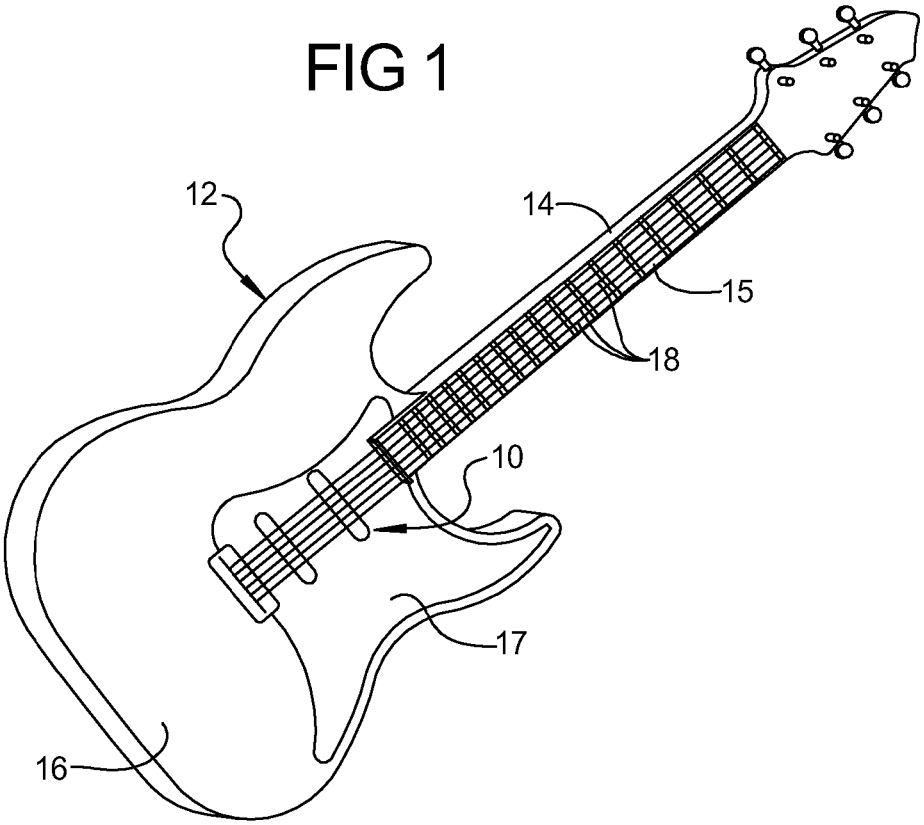
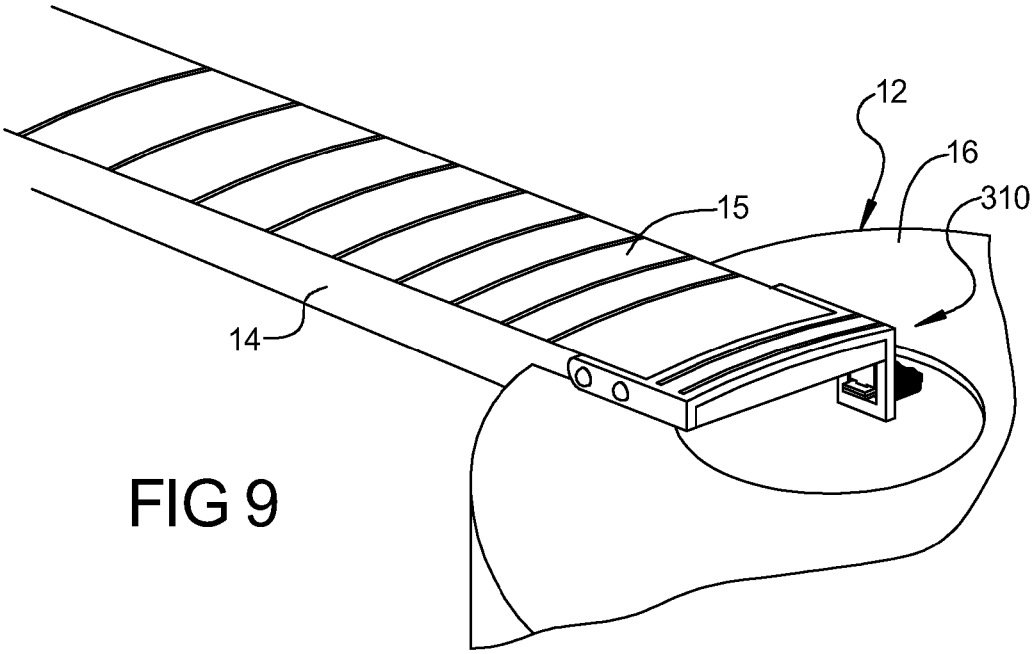
FIG 9

FIG 3
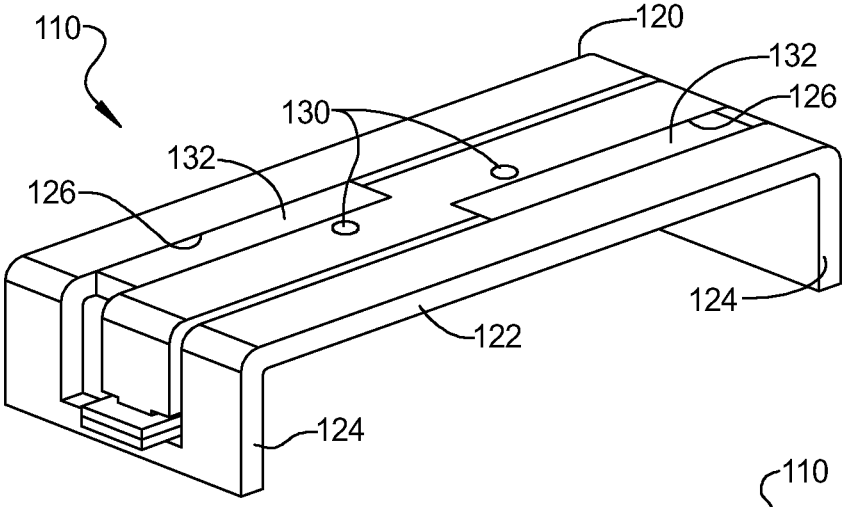
FIG 4
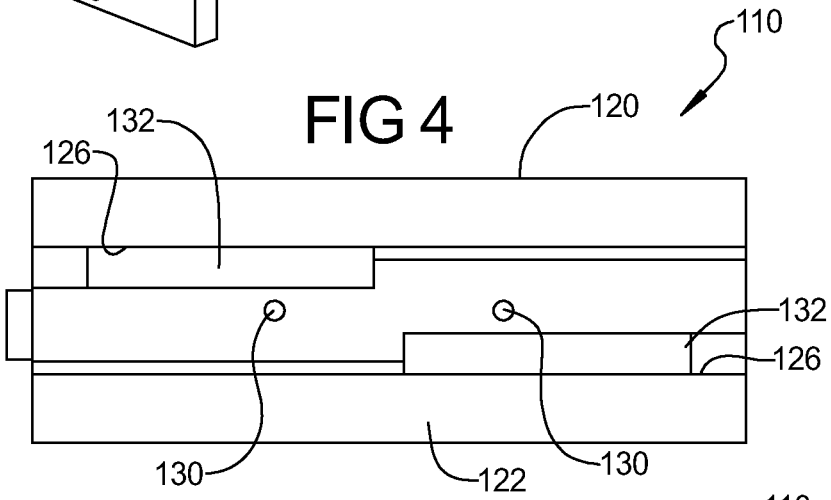
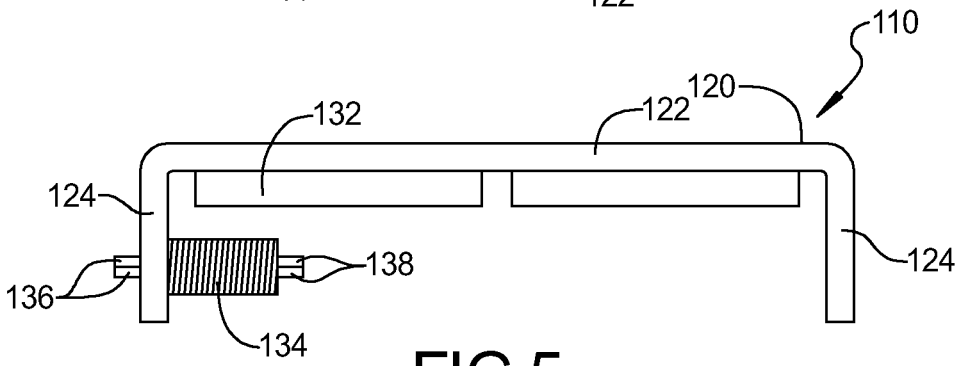
FIG 5

FIG 6
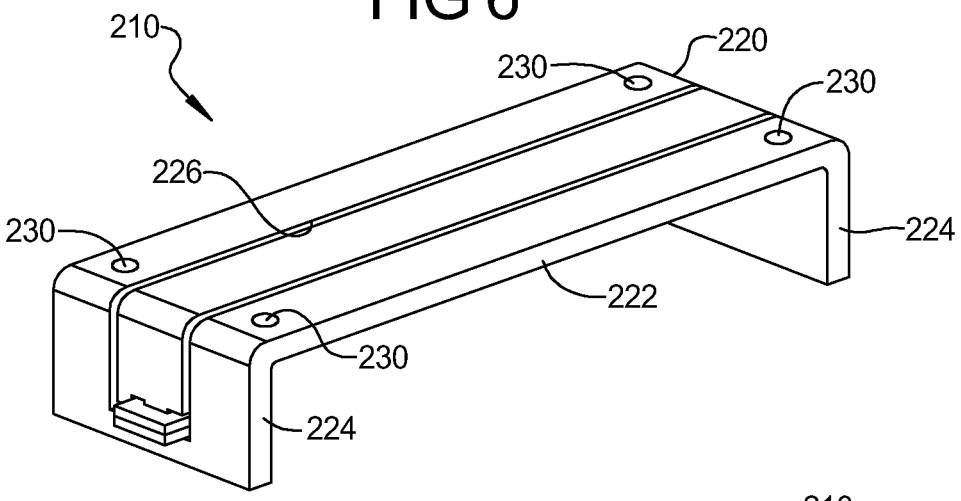
FIG 7
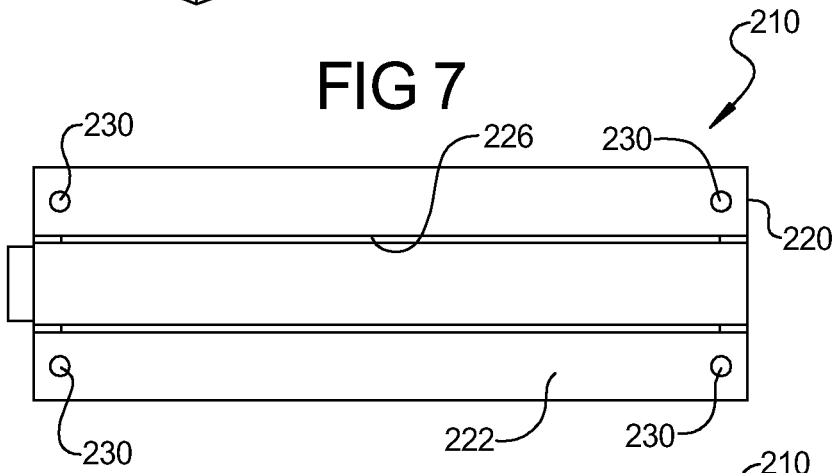
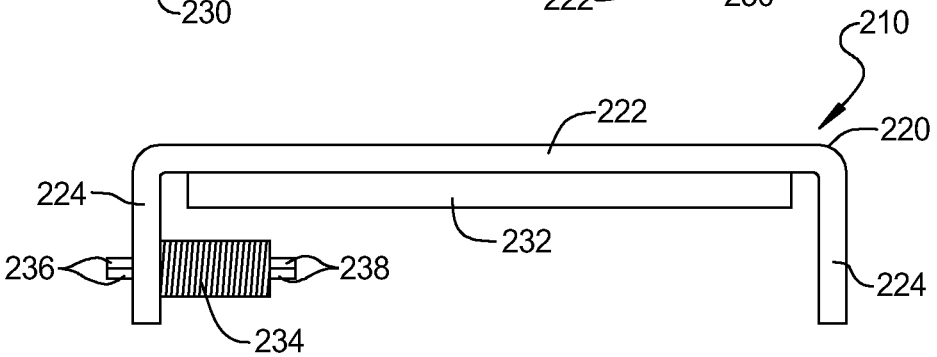
FIG 8

FIG 10
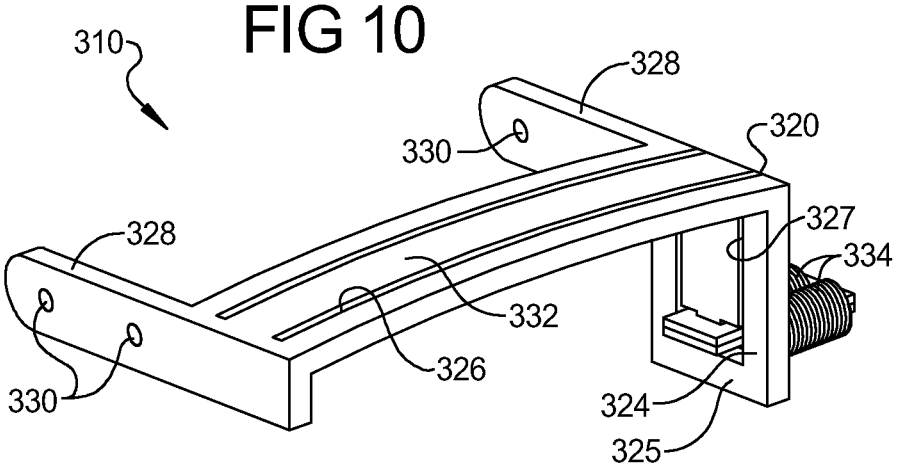
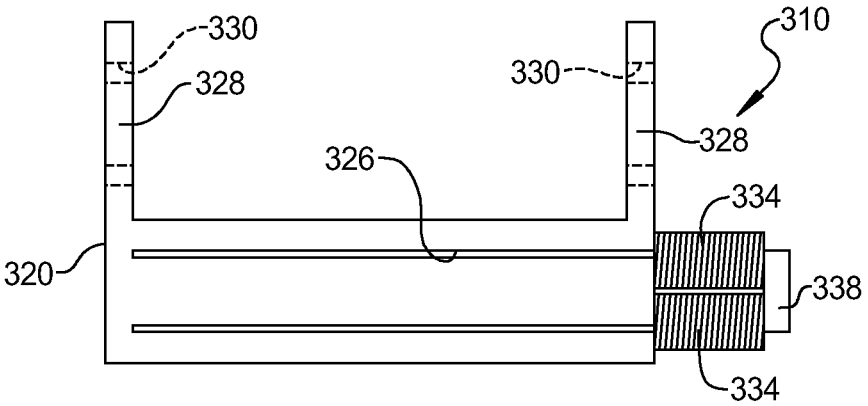
FIG 11
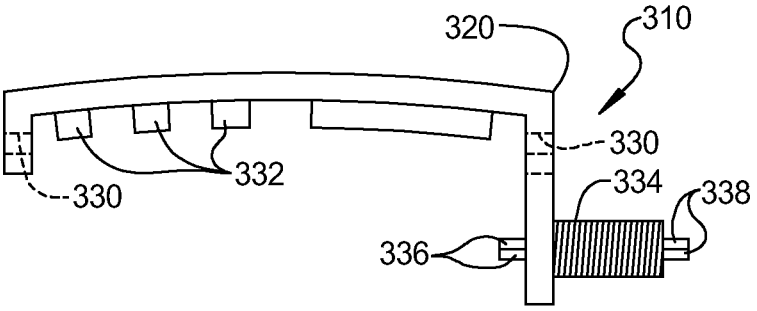
FIG 12

FIG 17
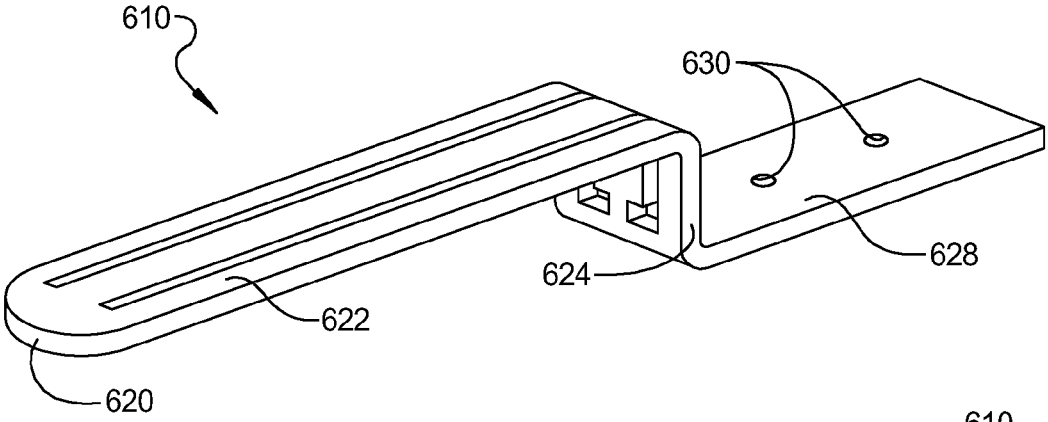
FIG 18
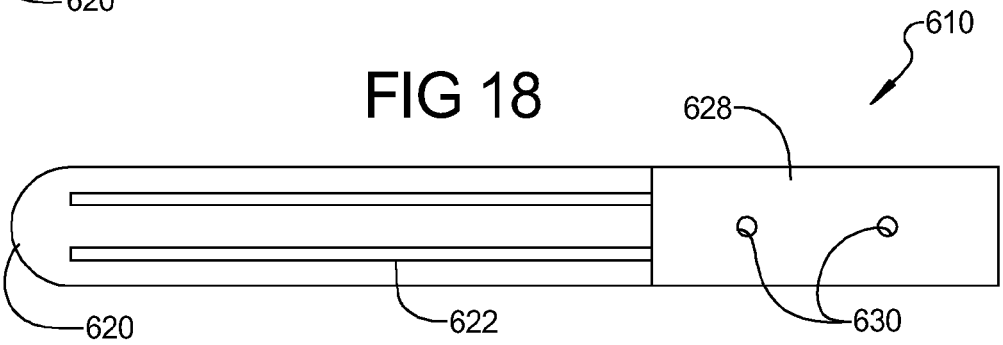
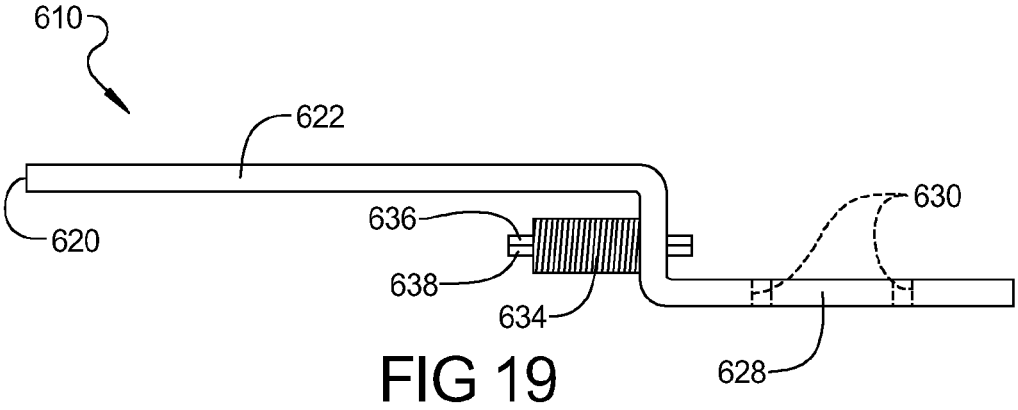
FIG 19

FIG 20
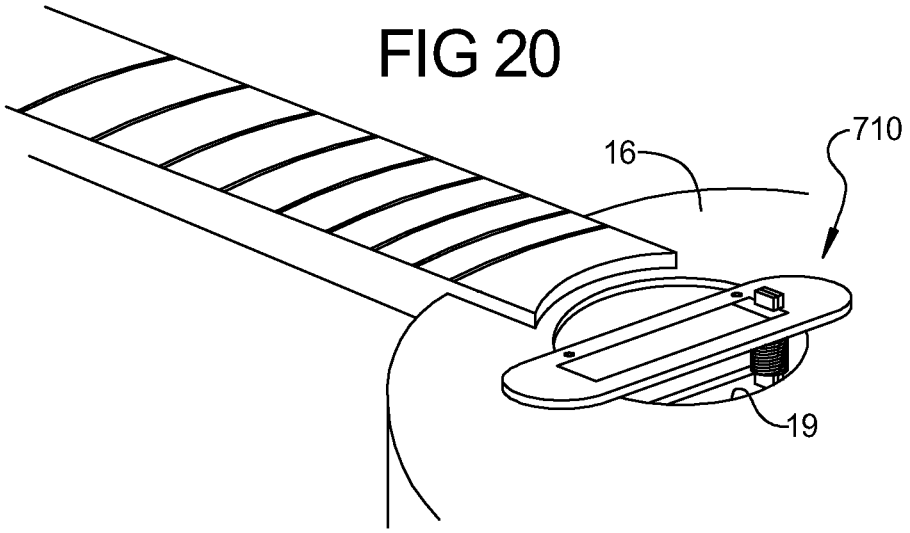
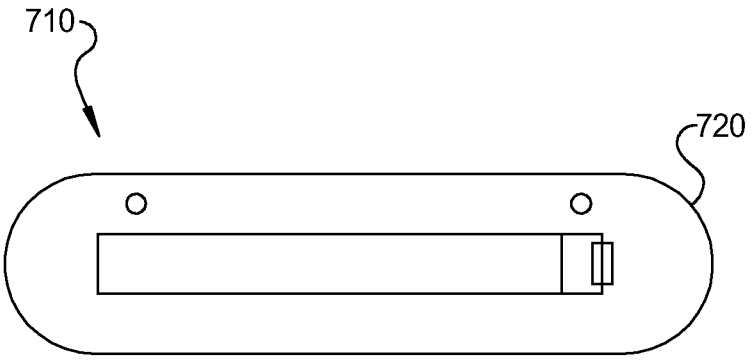
FIG 21
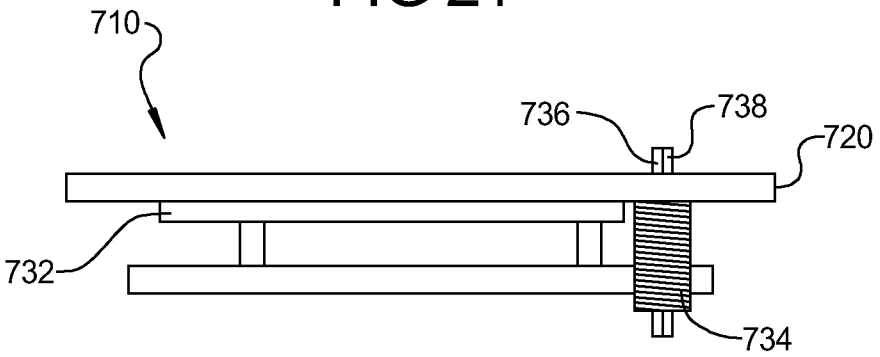
FIG 22

SENSOR ASSEMBLY FOR STRINGED MUSICAL INSTRUMENTS

BACKGROUND OF THE INVENTION

1. Field of the Invention

The present invention relates generally to musical instruments and, more particularly, to a sensor assembly for use with stringed musical instruments.

2. Description of the Related Art

Generally, stringed musical instruments such as electric guitars have electromagnetic sensors or pick-ups for sensing mechanical vibrations of the strings and converting such into electrical signals. The electrical signals from the electromagnetic sensors are amplified and modified and, ultimately, reconverted into acoustical energy to produce music and the like.

U.S. Pat. Nos. 5,501,900 and 5,438,157, issued to Lace, disclose an acoustic electromagnetic sensor assembly and mounting assembly for a stringed musical instrument. In these patents, the sensor assembly has a mounting assembly that fits in a sound hole of the stringed musical instrument. These electromagnetic sensors have a high visual impact when mounted on a stringed musical instrument such as an acoustic guitar. Further, these electromagnetic sensors typically have a tone and output that has a single value.

It is desirable to provide a sensor assembly that has an integral mounting assembly. It is also desirable to provide a sensor assembly that integrates an electrical primary winding with a mounting system. Therefore, there is a need in the art to provide a sensor assembly, which meets these desires.

SUMMARY OF THE INVENTION

It is, therefore, one object of the present invention to provide a sensor assembly for a stringed musical instrument.

It is another object of the present invention to provide an electromagnetic sensor that has an integral mounting assembly.

It is a further object of the present invention to provide an electromagnetic sensor for either an acoustic or electric stringed musical instrument having integration of the electrical and mounting system.

To achieve the foregoing objects, the present invention is a sensor assembly for a stringed musical instrument having a plurality of movable strings. The sensor assembly includes a primary winding extending outward to form a mounting member and adapted to be disposed on the stringed musical instrument. The sensor assembly includes at least one magnet disposed adjacent the primary winding and the movable strings to generate a magnetic field. The primary winding creates a primary current from a disruption in the magnetic field by the movable strings and the primary current creates a primary electromagnetic flux. The sensor assembly further includes at least one secondary being coupled to the primary winding. The at least one secondary winding transforms the primary electromagnetic flux into a secondary current adapted to pass out the stringed musical instrument.

One advantage of the present invention is that a new sensor assembly is provided for a stringed musical instrument. Another advantage of the present invention is that a sensor assembly is provided for a stringed musical instrument, which has an integral mounting system to mount the sensor assembly to the stringed musical instrument. Yet another advantage of the present invention is that the sensor assembly provides a primary winding that is integrated into the mounting system. A further advantage of the present invention is that the sensor assembly is aluminum based, rather than copper, resulting in less resistance, higher output coupled to a "current driven design" as opposed to conventional voltage based pickups. Yet a further advantage of the present invention is that the sensor assembly has more bass than traditional single coils, more volume, with mids slightly more than conventional pickups, and with highs that are clear yet smooth. Still a further advantage of the present invention is that the sensor assembly is available as an OEM factory installation or aftermarket installation.

Other objects, features, and advantages of the present invention will be readily appreciated, as the same becomes better understood, after reading the subsequent description taken in conjunction with the accompanying drawings.

BRIEF DESCRIPTION OF THE DRAWINGS

FIG. 1 is a perspective view of a sensor assembly, according to the present invention, illustrated in operational relationship with a stringed musical instrument.

FIG. 3 perspective view of another embodiment, according to the present invention, of the sensor assembly of FIG. 1.

FIG. 4 is a plan view of the sensor assembly of FIG. 3.

FIG. 5 is a front view of the sensor assembly of FIG. 3.

FIG. 6 is a perspective view of yet another embodiment, according to the present invention, of the sensor assembly of FIG. 1.

FIG. 7 is a plan view of the sensor assembly of FIG. 6.

FIG. 8 is a front view of the sensor assembly of FIG. 6.

FIG. 9 is a perspective view of still another embodiment, according to the present invention, of the sensor assembly of FIG. 1 illustrated in operational relationship with a stringed musical instrument.

FIG. 10 is a perspective view of the sensor assembly of FIG. 9.

FIG. 11 is a plan view of the sensor assembly of FIG. 9.

FIG. 12 is a front view of the sensor assembly of FIG. 9.

FIG. 17 is a perspective view of a yet still further embodiment, according to the present invention, of the sensor assembly of FIG. 1.

FIG. 18 is a plan view of the sensor assembly of FIG. 17.

FIG. 19 is a front view of the sensor assembly of FIG. 17.

FIG. 20 is a perspective view of another embodiment, according to the present invention, of the sensor assembly of FIG. 1 illustrated in operational relationship with a portion of a stringed musical instrument with the strings removed.

FIG. 21 is a plan view of the sensor assembly of FIG. 20.

FIG. 22 is a front view of the sensor assembly of FIG. 20.

DESCRIPTION OF THE PREFERRED EMBODIMENT(S)

Figure 2:
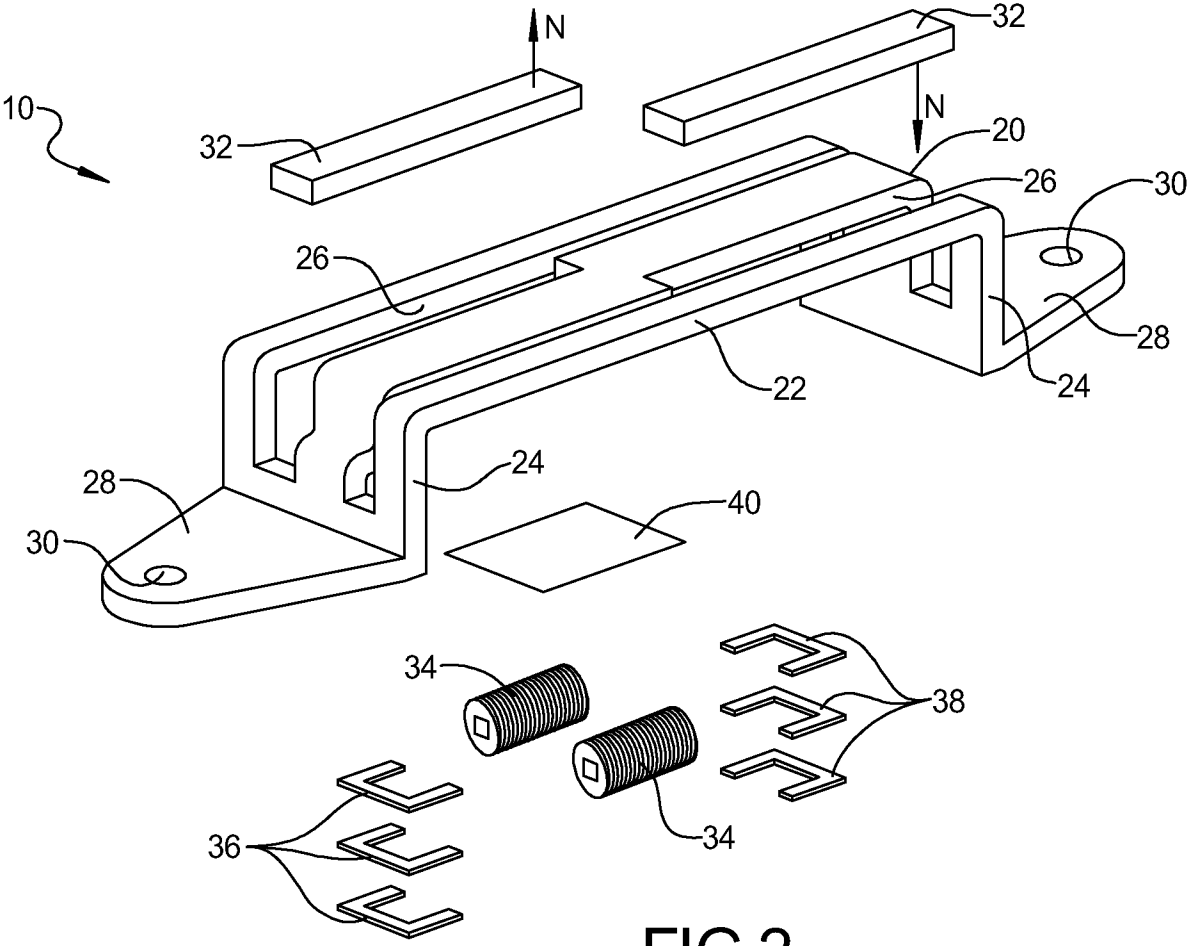
FIG. 2 is an exploded view of the sensor assembly of FIG. 1.

Referring to the drawings and, in particular, to FIGS. 1 and 2, one embodiment of a sensor assembly 10, according to the present invention, is illustrated in operational relationship with a stringed musical instrument, such as a guitar, generally indicated at 12. The guitar 12 is of the electric type having a neck portion 14 with a fingerboard 15, a body portion 16 with a pickguard 17, and a plurality of strings extending along the neck and body portions 14 and 16, respectively. The sensor assembly 10 is disposed beneath the strings 18 and mounted to the body portion 16 adjacent to the pickguard 17 in a manner to be described. Although the sensor assembly 10 is illustrated with a guitar 12, it should be appreciated that any suitable type of stringed musical instrument may be enhanced by the sensor assembly 10. It should also be appreciated that the sensor assembly 10 may be used with an acoustic type of stringed musical instrument 12. It should further be appreciated that one or more sensor assemblies 10 may be used with the stringed musical instrument 12.

Referring to FIG. 2, the sensor assembly 10 includes a primary winding 20 made from a non-ferrous material. Preferably, the primary winding 20 is made of a non-ferrous material such as aluminum. The primary winding 20 is preferably a solid piece of aluminum made as a single layer stamping or multilaminate construction. It should be appreciated that the primary winding 20 may be made of any suitable non-ferrous material.

The primary winding 20 has a configuration that acts as a one-turn receiver. In one embodiment, the primary winding 20 has a generally rectangular shape with a generally inverted U-shaped profile. As illustrated, the primary winding 20 has a top wall 22 extending laterally and opposed side walls 24 extending generally perpendicular from the lateral ends of the top wall 22 to form the inverted U-shape. The primary winding has at least one preferably a pair of slots 26 spaced laterally and longitudinally and extending therethrough. The slots 26 are generally rectangular in shape. The primary winding 20 has a predetermined length. Preferably, the primary winding 20 extends to encompass all of the moveable strings 18. The primary winding 20 includes a mounting flange 28 extending laterally from the end of each of the side walls 24. Each mounting flange 28 includes at least one mounting aperture 30 extending therethrough to receive a fastener (not shown) to secure the primary winding 20 to the body portion 16 of the stringed musical instrument 10. It should be appreciated that the primary winding 20 may be configured to have other suitable shapes other than the rectangular shape. It should also be appreciated that the primary winding 20 may be a plurality of windings.

The sensor assembly 10 also includes at least one, preferably a plurality of magnets 32 disposed adjacent the primary winding 20 to provide a magnetic flux field to the strings 18. The magnets 32 are generally rectangular in shape. The magnets 32 are disposed in the slots 28 and secured to the primary winding 20 by suitable means such as an adhesive bonding agent. The magnets 32 are a permanent magnet strip and made of a flexible permanent magnet material such as PLASTIFORM® which is commercially available from Arnold Engineering, Marango, Ill. The magnets 32 also can be ceramic, neodymium, or alnico magnets 32. It should be appreciated that the magnets 32 are orientated in a manner such that one magnet 32 has magnetic polar North (N) facing upward and the other magnet 32 has N facing downward.

The sensor assembly 10 also includes at least one, preferably a plurality of secondary windings 34 adjacent to the primary winding 20. In one embodiment, the secondary windings extend generally perpendicular to the primary winding 20. The secondary windings 34 are coils of a conductive wire such as copper wrapped around core elements 36,38 to be described. It should be appreciated that the secondary windings 34 can be either single or multiple coils connected in series or parallel.

The secondary windings 34 are susceptible to electromagnetic flux transferred by the core elements 36,38 from the primary winding 20. The secondary windings 34 transform the primary electromagnetic flux into a secondary current. More specifically, the primary winding 20 and the secondary windings and the core elements 36,38 act together as a transformer which transforms the primary current into the secondary current. The secondary current is passed through an output port (not shown) to electronics subsequent to the sensor assembly 10. Although the primary winding 20 is shown to be a separate circuit than that of the secondary windings 34, the secondary windings 34 may in another embodiment (not shown) be connected in series to the primary winding 20 at a common point to create an autotransformer. It should be appreciated that possible electronic components, which may be operatively connected to the output port include receivers, synthesizers, amplifiers, speakers, and the like.

The secondary windings 34 are shorter in length than the predetermined length of the primary winding 20. The secondary windings 34 include a first core element 36, which extends through one end of the secondary windings 34 and a second core element 38, which extends through the other end of the secondary windings 34. In one embodiment, the first and second core elements 36,38, which are "U" shaped in appearance, extend into the secondary windings 34 from each end and telescopingly engage. The core elements 36,38 are made from laminations of a high permeable magnetic material such as steel. It should be appreciated that the sensor assembly 10 may have a single secondary winding 34 or multiple secondary windings 34 that can be combined in different ways to create a variety of tones. It should also be appreciated that the multiple secondary windings 34 may be configured in a dual parallel arrangement or with a potentiometer (not shown). It should further be appreciated that the use of multiple secondary windings 34 provides flexibility in the tone and output of the sensor assembly 10. It should be still further appreciated that the multiple secondary windings 34 can be a variety of values and can be used with an elongated primary winding 20 to allow flexibility in the design and placement of the sensor assembly 10.

The sensor assembly 10 further includes a magnetic field barrier 40 disposed between the primary winding 20 and the secondary windings 34. The magnetic field barrier 40 is disposed about a portion of the primary winding 20 and between the secondary windings 34 and the primary winding 20. The magnetic field barrier 40 is generally rectangular in shape. The magnetic field barrier 40 shields at least a portion of the secondary windings 34 to minimize the sensitivity thereof to extraneous environmental electromagnetic flux, i.e., electromagnetic flux created by other pieces of electrical equipment. The magnetic field barrier 40 may be fixedly secured to the primary winding 20 via any suitable securing device, such as an adhesive epoxy.

Referring to FIGS. 3 through 5, another embodiment, according to the present invention, of the sensor assembly 10 is shown. Like parts of the sensor assembly 10 have like reference numerals increased by one hundred (100). In this embodiment, the sensor assembly 110 includes a primary winding 120, magnets 132, secondary windings 134, and core elements 136,138. The primary winding 120 has a top wall 122, side walls 124, and slots 126 extending through the top wall 122 to receive the magnets 132. As illustrated, the primary winding 120 of the sensor assembly 110 eliminates the mounting flanges and instead has mounting apertures 130 extending through the top wall 122 to receive a fastener (not shown) to secure the primary winding 120 to the body portion 16 of the guitar 12. In the embodiment illustrated, the mounting apertures 130 are spaced laterally from each other and longitudinally between the magnets 132 such that the mounting apertures 130 are generally centrally located. It should be appreciated that the top wall 122 of the primary winding 120 may have one or more mounting apertures 130 extending therethrough. It should also be appreciated that the sensor assembly 110 may include the magnetic field barrier (not shown).

Referring to FIGS. 6 through 8, yet another embodiment, according to the present invention, of the sensor assembly 10 is shown. Like parts of the sensor assembly 10 have like reference numerals increased by two hundred (200). In this embodiment, the sensor assembly 210 includes a primary winding 220, magnets 232, secondary windings 234, and core elements 236,238. The primary winding 220 has a top wall 222, side walls 224, and slots 226 extending through the top wall 222 with the magnets 232 affixed below by a suitable adhesive. As illustrated, the primary winding 220 of the sensor assembly 210 has a single slot 226 extending laterally with a single magnet 232 affixed below. The primary winding 220 of the sensor assembly 210 also eliminates the mounting flanges and instead has mounting apertures 230 extending through the top wall 222 to receive a fastener (not shown) to secure the primary winding 220 to the body portion 16 of the guitar 12. In the embodiment illustrated, the mounting apertures 230 are spaced laterally from each other and longitudinally with the magnets 232 disposed longitudinally therebetween such that the mounting apertures 230 are generally located near the corners of the top wall 222. It should be appreciated that the top wall 222 of the primary winding 220 may have one or more mounting apertures 230 extending therethrough. It should also be appreciated that the sensor assembly 210 may include the magnetic field barrier (not shown).

Referring to FIGS. 9 through 12, still another embodiment, according to the present invention, of the sensor assembly 10 is shown. Like parts of the sensor assembly 10 have like reference numerals increased by three hundred (300). In this embodiment, the sensor assembly 310 is mounted at the end of the neck 14 or fingerboard 15 proximate to the body portion 16. The sensor assembly 310 can be attached to the fingerboard 15 or body portion 16 by suitable means such as fasteners (not shown). In this embodiment, the sensor assembly 310 includes a primary winding 320, magnets 332, secondary windings 334, and core elements 336,338. The primary winding 320 has a general "L" shape profile. The primary winding 320 has a top wall 322, a side wall 324, a bottom wall 325 at the bottom of the side wall 324, and slots 326 and 327 extending through the top wall 322 and side wall 324, respectively. As illustrated, the primary winding 320 of the sensor assembly 310 has a single slot 326 extending laterally through the top wall 322 and a single slot 327 extending through the side wall 324. The sensor assembly 310 has a plurality of magnets 332 disposed below the top wall 322 and spaced laterally therealong. The magnets 332 are generally rectangular in shape and extend longitudinally across the slot 326. The magnets 332 are secured to the top wall 322 by a suitable mechanism such as an adhesive. It should be appreciated that the magnets 332 are asymmetrically affixed to a surface of the primary winding 320 adjacent to a slot 326. It should also be appreciated that, as long as the magnets 332 are affixed to the surface of the primary winding 320 and not within the slot(s) 326, the humbucking inductance balance of the primary winding 320 is not affected such that the overall humbucking inductance of the sensor assembly 310 does not change.

The primary winding 320 of the sensor assembly 310 also includes a mounting flange 328 extending longitudinally from the each lateral end of the top wall 322. Each mounting flange 328 includes at least one mounting aperture 330 extending therethrough to receive a fastener (not shown) to secure the primary winding 320 to the body portion 16 of the guitar 12. In the embodiment illustrated, the mounting apertures 330 are spaced longitudinally from each other. It should be appreciated that the sensor assembly 310 may include the magnetic field barrier (not shown).

Figure 13:
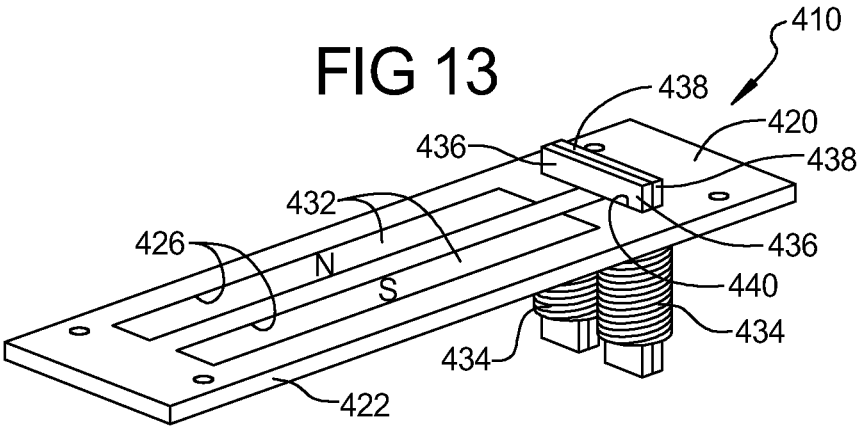
FIG. 13 is a perspective view of a further embodiment, according to the present invention, of the sensor assembly of FIG. 1.
Figure 14:
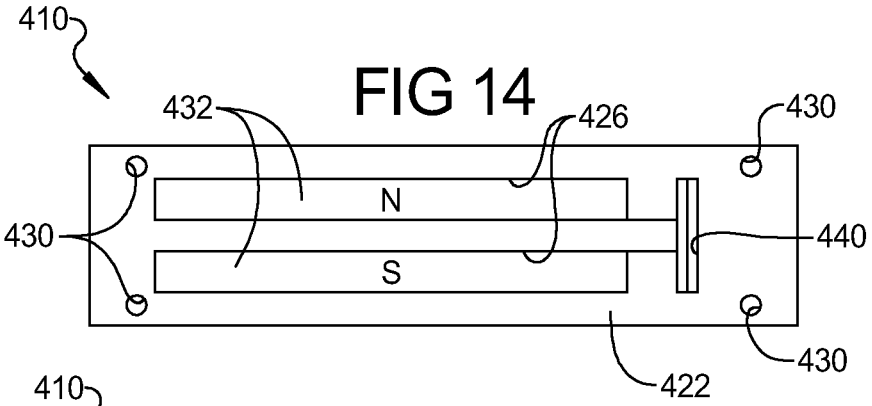
FIG. 14 is a plan view of the sensor assembly of FIG. 13.
Figure 15:
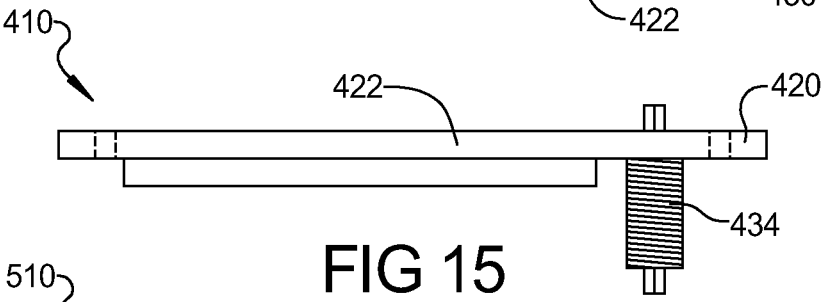
FIG. 15 is a front view of the sensor assembly of FIG. 13.

Referring to FIGS. 13 through 15, a further embodiment, according to the present invention, of the sensor assembly 10 is shown. Like parts of the sensor assembly 10 have like reference numerals increased by four hundred (400). In this embodiment, the sensor assembly 410 includes a primary winding 420, magnets 432, secondary windings 434, and core elements 436,438. The primary winding 420 has a generally planar and rectangular top wall 422 and slots 426 extending through the top wall 422 to receive the magnets 432. As illustrated, the primary winding 420 of the sensor assembly 410 has a pair of slots 426 extending laterally and spaced longitudinally to receive a single magnet 432 in each of the slots 426. The primary winding 420 of the sensor assembly 410 also eliminates the mounting flanges and instead has mounting apertures 430 extending through the top wall 422 to receive a fastener (not shown) to secure the primary winding 420 to the body portion 16 of the guitar 12. In the embodiment illustrated, the mounting apertures 430 are spaced laterally from each other and longitudinally with the magnets 432 disposed longitudinally therebetween such that the mounting apertures 430 are generally located near the corners of the top wall 422. It should be appreciated that the top wall 422 of the primary winding 420 may have one or more mounting apertures 430 extending therethrough.

The primary winding 420 of the sensor assembly 410 also eliminates the side walls and instead has at least one, preferably a plurality of slots 440 extending through the top wall 422 to receive the core elements 436,438 for the secondary windings 434. In the embodiment illustrated, the slots 440 are generally rectangular in shape. The slots 440 are spaced laterally from the slots 426 and spaced longitudinally from each other such that one slot 440 is aligned with one slot 426. The core elements 436,438 are linear and generally rectangular in shape. The core elements 436,438 for each secondary winding 434 have one end disposed in one of the slots 440 and secured to the primary winding 420 by an interference fit therein. It should also be appreciated that the sensor assembly 410 may include the magnetic field barrier (not shown). It should also be appreciated that the sensor assembly 410 is a dual element, dual pick-up with a single primary winding 420.

Figure 16:
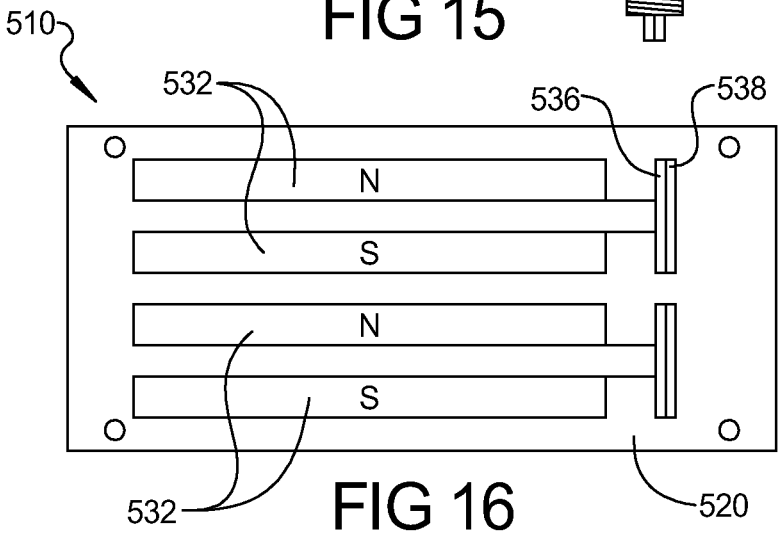
FIG. 16 is a plan view of a still further embodiment, according to the present invention, of the sensor assembly of FIG. 1.

Referring to FIG. 16, a still further embodiment, according to the present invention, of the sensor assembly 10 is shown. Like parts of the sensor assembly 10 have like reference numerals increased by five hundred (500). In this embodiment, the sensor assembly 510 includes a primary winding 520, magnets 532, secondary windings, and core elements 536,538. As illustrated, the primary winding 520 of the sensor assembly 510 has a plurality of, preferably four, slots 526 extending laterally and spaced longitudinally to receive a single magnet 532 in each of the slots 526. In the embodiment illustrated, the magnets 532 are alternated between magnetic polar North (N) and magnetic polar South (S). It should be appreciated that the sensor assembly 510 may include the magnetic field barrier (not shown).

Referring to FIGS. 17 through 19, a yet still further embodiment, according to the present invention, of the sensor assembly 10 is shown. Like parts of the sensor assembly 10 have like reference numerals increased by six hundred (600).

In this embodiment, the sensor assembly 610 is mounted to the body portion 16 of a jazz type guitar 12. The sensor assembly 610 is attached to the body portion 16 by suitable means such as fasteners (not shown).

In this embodiment, the sensor assembly 610 includes a primary winding 620, magnets 632, secondary windings 634, and core elements 636,638. The primary winding 620 has a general "L" shape profile. The primary winding 620 has a top wall 622, a side wall 624, and at least one slot 626 extending through the top wall 622. As illustrated, the primary winding 620 of the sensor assembly 610 has a dual slot 626 extending laterally through the top wall 622. The sensor assembly 610 has a plurality of magnets 632 disposed below the top wall 622 and spaced laterally therealong. The magnets 632 are generally rectangular in shape and extend longitudinally across the slot 626. The magnets 632 are secured to the top wall 622 by a suitable mechanism such as an adhesive.

The primary winding 620 of the sensor assembly 610 also includes a mounting flange 628 extending laterally from the bottom end of the side wall 624. The mounting flange 628 includes at least one mounting aperture 630 extending therethrough to receive a fastener (not shown) to secure the primary winding 620 to the body portion 16 of the guitar 12. In the embodiment illustrated, two mounting apertures 630 are spaced laterally from each other. It should be appreciated that the sensor assembly 610 may include the magnetic field barrier (not shown). It should also be appreciated that the sensor assembly 610 may be integral with the pickguard 17 of the guitar 12.

Referring to FIGS. 20 through 22, another embodiment, according to the present invention, of the sensor assembly 10 is shown. Like parts of the sensor assembly 10 have like reference numerals increased by seven hundred (700). In this embodiment, the sensor assembly 710 is mounted to the body portion 16 proximate to the sound hole 19 of an acoustic type guitar 12. The sensor assembly 710 can be attached to the body portion 16 by suitable means such as fasteners (not shown).

In this embodiment, the sensor assembly 710 includes a primary winding 720, magnets 732, a secondary winding 734, and core elements 736,738. The primary winding 720 has a generally planar top wall 722 and a slot 726 extending through the top wall 722. As illustrated, the primary winding 720 of the sensor assembly 710 has a clamp bar to receive a single magnet 732 positioned under the slot 726. The primary winding 720 of the sensor assembly 710 also eliminates the mounting flanges and instead has mounting apertures 730 extending through the top wall 722 to receive a fastener (not shown) to secure the primary winding 720 to the body portion 16 of the guitar 12. It should be appreciated that the top wall 722 of the primary winding 720 may have one or more mounting apertures 730 extending therethrough.

The primary winding 720 of the sensor assembly 710 also eliminates the side walls and instead has a slot 740 extending through the top wall 722 to receive the core elements 736,738 for the secondary winding 734. In the embodiment illustrated, the slot 740 is generally rectangular in shape. The slot 740 is spaced laterally from the slot 426 such that the slot 740 is aligned with the slot 726. The core elements 736,738 are linear and generally rectangular in shape. The core elements 736,738 for the secondary winding 734 have one end disposed in the slot 740 and secured to the primary winding 720 by an interference fit therein. It should also be appreciated that the sensor assembly 710 may include the magnetic field barrier (not shown). It should also be appreciated that, when the sensor assembly 710 is mounted to the guitar 12 that the clamp bar extends into the sound hole 19 of the guitar 12. It should also be appreciated that the secondary winding 730 is disposed within the sound hole 19.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A sensor assembly for a stringed musical instrument having a plurality of movable strings comprising:

a primary winding made of a one-piece solid aluminum material forming an integral and unitary mounting flange extending outward as a mounting member and having at least one aperture extending therethrough to allow a fastener to extend through the aperture to secure said primary winding to the stringed musical instrument;

at least one magnet disposed adjacent said primary winding to generate a magnetic field, said primary winding creating a primary current from a disruption in the magnetic field by the movable strings, the primary current creating a primary electromagnetic flux; and at least one secondary winding being coupled to said primary winding, said at least one secondary winding transforming the primary electromagnetic flux into a secondary current adapted to pass out the stringed musical instrument.

2. A sensor assembly as set forth in claim 1 wherein said primary winding includes top wall extending laterally to encompass the plurality of strings.

3. A sensor assembly as set forth in claim 2 wherein said primary winding includes a side wall extending perpendicularly from said top wall to form a general U-shape for said primary winding, said mounting flange extending perpendicularly from said side wall.

4. A sensor assembly as set forth in claim 3 wherein said at least one secondary winding is orientated generally perpendicular to said side wall.

5. A sensor assembly as set forth in claim 2 wherein said at least one secondary winding is orientated generally perpendicular to said top wall.

6. A sensor assembly as set forth in claim 2 wherein said primary winding has at least one slot extending through said top wall.

7. A sensor assembly as set forth in claim 1 wherein said primary winding has a generally planar shape and a slot extending through said primary winding.

8. A sensor assembly as set forth in claim 1 wherein said at least one magnet is generally rectangular in shape.

9. A sensor assembly as set forth in claim 1 wherein said at least one magnet comprises a plurality of magnets spaced laterally beneath said primary winding.

10. A sensor assembly as set forth in claim 1 including a first core element extending through one end of said at least one secondary winding and a second core element extending through the other end of said at least one secondary winding, said first core element and said second core element adapted to receive the electromagnetic flux from said primary winding and transform the electromagnetic flux into the secondary current.

11. A sensor assembly as set forth in claim 10 wherein said first and second core elements are substantially "U" shaped and are adapted to telescopingly engage each other.

12. A sensor assembly as set forth in claim 10 wherein said first and second core elements are substantially rectangular shaped and are adapted to engage each other.

13. A sensor assembly for a stringed musical instrument having a plurality of movable strings comprising:

a plurality of magnets adapted to be disposed below the strings to generate a magnetic field;

a primary winding operatively supporting said magnets to create a primary current from a disruption in the magnetic field by the movable strings, the primary current creating a primary electromagnetic flux, said primary winding made of a one-piece solid aluminum material forming an integral and unitary mounting flange extending laterally outward as a mounting member and having at least one aperture extending therethrough to allow a fastener to extend through the aperture to secure said primary winding to the stringed musical instrument; and at least one secondary winding being magnetically coupled to said primary winding, said at least one secondary winding transforming the primary electromagnetic flux into a secondary current adapted to be passed out the stringed musical instrument.

14. A sensor assembly as set forth in claim 13 wherein said primary winding defines at least one slot extending through said primary winding and said plurality of magnets are asymmetrically affixed to a surface of said primary winding adjacent to said at least one slot such that the overall humbucking inductance of said sensor assembly does not change.

15. A sensor assembly for a stringed musical instrument having a plurality of movable strings comprising:

a plurality of magnets adapted to be disposed below the strings to generate a magnetic field;

a primary winding operatively supporting said magnets to create a primary current from a disruption in the magnetic field by the movable strings, the primary current creating a primary electromagnetic flux, said primary winding made of a one-piece solid aluminum material forming a top wall extending laterally to encompass the plurality of strings, a side wall extending perpendicularly from said top wall to form a general U-shape for said primary winding, and a mounting flange extending perpendicularly from said side wall as an integral and unitary mounting member having at least one aperture extending therethrough to allow a fastener to extend through the aperture to secure said primary winding to the stringed musical instrument.

* * * * *